US007444693B2

(12) United States Patent
Russo et al.

(10) Patent No.: US 7,444,693 B2
(45) Date of Patent: Nov. 4, 2008

(54) INFLATABLE LIFT DEVICE

(75) Inventors: Joseph A. Russo, Pittsburgh, PA (US); Richard J. Mascara, Pittsburgh, PA (US); James O. Poepperling, Pittsburgh, PA (US)

(73) Assignee: Endetek, Inc., Cranberry, PA (US)

( * ) Notice: Subject to any disclaimer, the term of this patent is extended or adjusted under 35 U.S.C. 154(b) by 68 days.

(21) Appl. No.: 11/199,278

(22) Filed: Aug. 8, 2005

(65) Prior Publication Data

US 2007/0028380 A1 Feb. 8, 2007

(51) Int. Cl.
*A61G 7/10* (2006.01)

(52) U.S. Cl. ..... 5/81.1 R; 5/81.1 T

(58) Field of Classification Search ..... 5/81.1 R, 5/81.1 T, 655.3, 653
See application file for complete search history.

(56) References Cited

U.S. PATENT DOCUMENTS

| | | | | | |
|---|---|---|---|---|---|
| 4,005,498 | A * | 2/1977 | Starr et al. | ..... | 5/81.1 R |
| 4,271,546 | A * | 6/1981 | Martin | ..... | 5/604 |
| 5,020,168 | A | 6/1991 | Wood | | |
| 5,361,433 | A * | 11/1994 | Vanzant | ..... | 5/81.1 R |
| 5,669,086 | A * | 9/1997 | Garman | ..... | 5/86.1 |
| 5,742,957 | A | 4/1998 | Vanzant | | |
| 5,988,747 | A * | 11/1999 | Jeans | ..... | 297/313 |
| 6,154,900 | A | 12/2000 | Shaw | | |
| 6,276,006 | B1 * | 8/2001 | Hoit | ..... | 5/81.1 R |
| 6,298,511 | B1 | 10/2001 | Collymore | | |
| 6,378,147 | B1 | 4/2002 | Halleran | | |
| 6,442,779 | B1 | 9/2002 | LeVert et al. | | |
| 6,651,280 | B2 | 11/2003 | Blevins | | |
| 6,715,164 | B2 | 4/2004 | Steadman et al. | | |
| 6,718,584 | B2 | 4/2004 | Rabaiotti et al. | | |
| 6,857,144 | B1 | 2/2005 | Huang | | |
| 6,886,204 | B2 | 5/2005 | Kasatschko et al. | | |
| 6,901,617 | B2 * | 6/2005 | Sprouse et al. | ..... | 5/654 |
| 2002/0133877 | A1 | 9/2002 | Kuiper et al. | | |
| 2002/0144343 | A1 | 10/2002 | Kuiper et al. | | |
| 2005/0028875 | A1 | 2/2005 | German et al. | | |

* cited by examiner

*Primary Examiner*—Fredrick Conley
(74) *Attorney, Agent, or Firm*—The Webb Law Firm

(57) ABSTRACT

The present invention is an inflatable lift device. The lift device includes a flat blanket with a plurality of inflatable bladders, an air supply coupled to each of the inflatable bladders, and a controller coupled to the air supply for controlling the air supply to sequentially inflate the plurality of inflatable bladders thereby raising a patient from a supine or prone position to a seated position. The plurality of inflatable bladders may include inflatable side rails, inflatable armrests, an inflatable back support and an inflatable lift as well as optional inflatable tilt bladders to raise the patient from a seated position to a standing position.

17 Claims, 10 Drawing Sheets

INFLATABLE LIFT DEVICE

BACKGROUND OF THE INVENTION

1. Field of the Invention

The present invention relates to a lift device and, more particularly, to a lift device including a plurality of inflatable bladders.

2. Description of Related Art

Individuals who lack a capacity to stand or move themselves from the prone or supine position into a seated or standing position must rely on outside assistance to achieve the desired position. Currently, there are a variety of methods to assist such an individual including assistance by attendants, assistance by loved ones or significant others, assistance by Trained Nurses, or assistance by means of mechanical devices. Each of these methods, however, suffers from various drawbacks.

For instance, if the assistant is one person, such as an attendant or nurse, then that person must be strong enough to navigate both himself and a patient. The individual must be experienced and know the proper procedure for moving a patient from a down position. There are frequent injuries to both patient and assistant when an assistant attempts to move a fallen patient. According to the Bureau of Labor Statistics, nursing aides, orderlies and attendants reported more musculoskeletal disorders requiring time off from work than any other occupation. Many of these disorders were due to overexertion related to lifting or moving patients.

Current mechanical lift devices also suffer from a variety of drawbacks. These devices are very bulky, heavy and difficult to maneuver and store. Furthermore, current mechanical lifts can create bruising and stress marks due to the focused forces caused by the straps when a patient's weight is not evenly distributed. An example of such a mechanical lift device can be found in U.S. Pat. No. 6,857,144 to Huang.

Inflatable lift devices also exist in the prior art, however, these devices also suffer from various drawbacks. U.S. Pat. No. 5,669,086 to Garman, for instance, discloses a mobile lifting apparatus that includes a stack of inflatable bags for lifting a patient off the ground. However, this device requires a ramp for positioning the patient on the device. Therefore, this device cannot be positioned beneath a patient without moving the patient. Furthermore, this device merely lifts a patient off the ground and does not include inflatable side rails, armrests, and a backrest that helps the patient from a position on the ground to a seated position and, finally, to a standing position.

Accordingly, a need exists for a device that easily lifts a patient who has fallen without the need for an assistant to exert strenuous force. A further need exists for an inflatable lift device that provides support for a patient's arms and back while slowly lifting the patient to a seated or standing position.

SUMMARY OF THE INVENTION

The present invention is an inflatable lift device. The lift device includes a flat blanket with a plurality of inflatable bladders and an air supply coupled to at least one of the inflatable bladders. The plurality of inflatable bladders are sequentially inflatable for raising a patient from a supine or prone position to a seated position.

The plurality of inflatable bladders may include inflatable side rails, inflatable armrests, an inflatable back support, an inflatable lift, or any combination thereof. The plurality of inflatable bladders may further include at least one inflatable tilt bladder connected to a bottom portion of the blanket that is operable to raise the device and therefore the patient from a seated position to a standing position.

The bottom of the flat blanket may also include a non-skid material with a specified coefficient of friction to prevent the flat blanket from slipping. The inflatable lift device may also include a base with wheels or retractable wheels to allow for easy transportation of a fallen patient. A securing harness and handles may also be provided on the inflatable lift device. When not in use, the flat blanket may be foldable for storage. The inflatable lift device may also include a sheet with handles for transferring a patient from the device to a bed, chair or the like.

The air supply may include an air source, an air regulator, a pneumatic solenoid, or any combination thereof. The inflatable lift device may also include a controller coupled to the air supply for controlling the supply of air to the at least one inflatable bladder.

The present invention is further directed to an inflatable lift device for lifting a patient from a supine or prone position to a seated position and includes a flat blanket including inflatable side rails, inflatable armrests, an inflatable backrest, an inflatable lift or any combination thereof, and an air supply in fluid communication with at least one of the inflatable side rails, inflatable armrests, inflatable backrest and inflatable lift, wherein the air supply is operable to sequentially inflate at least one of the inflatable side rails, inflatable armrests, inflatable backrest and inflatable lift.

The present invention is also directed to an inflatable lift device comprising a blanket means for housing a plurality of inflatable bladders and an air supply means coupled to at least one of the inflatable bladders for supplying air to at least one of the inflatable bladders, wherein the plurality of inflatable bladders are sequentially inflatable for raising a patient from a supine or prone position to a seated position.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
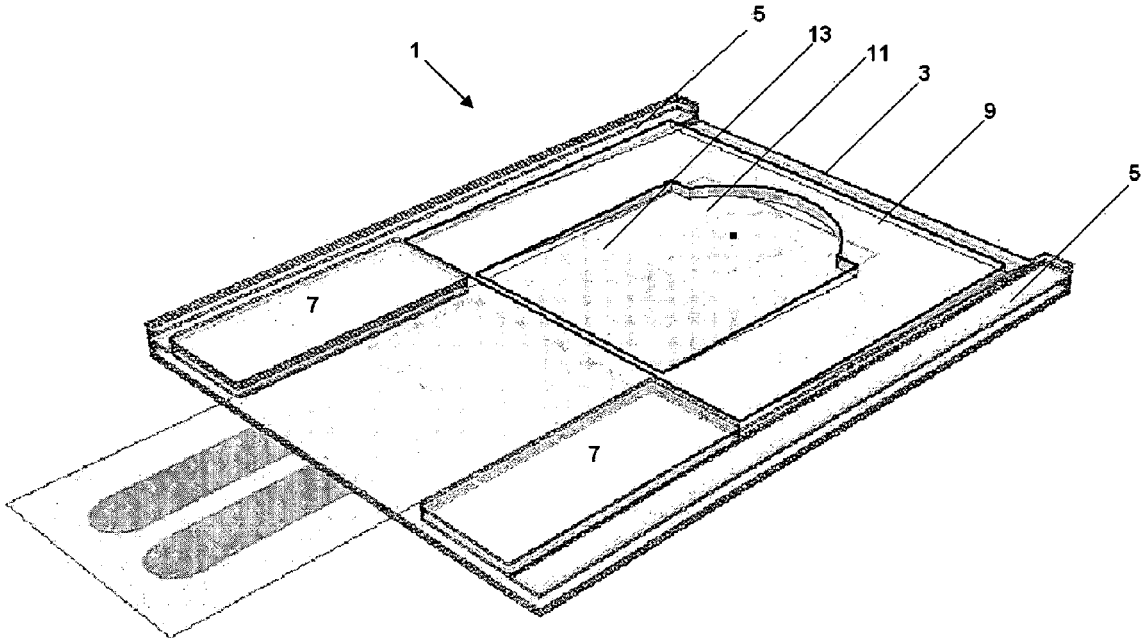
FIG. 1 is a perspective view of an inflatable lift device in an uninflated state in accordance with the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

With reference to FIG. 1, an inflatable lift device 1 includes a flat blanket 3 comprising a plurality of inflatable bladders. The inflatable bladders include, but are not limited to, inflatable side rails 5, inflatable armrests 7 and an inflatable backrest 9. Inflatable backrest 9 further includes a molded cavity 11 that provides a comfortable position for the patient and keeps the patient stable by decreasing the ability to roll from side to side. The inflatable lift device will permit anyone to be able to help lift a person in need from the supine (i.e., face up) or prone (i.e., face down) to a sitting or orthostatic (i.e., standing) position.

The first step in lifting a patient using the inflatable lift device 1 of the present invention is to position the patient in a correct position on flat blanket 3 as shown by the silhouetted FIG. 13 in FIG. 1. This can be accomplished by either positioning the patient onto flat blanket 3 or sliding flat blanket 3 underneath the fallen patient. The underside of flat blanket 3 may include a non-skid material with a high coefficient of friction to prevent flat blanket 3 from sliding.

Figure 2:
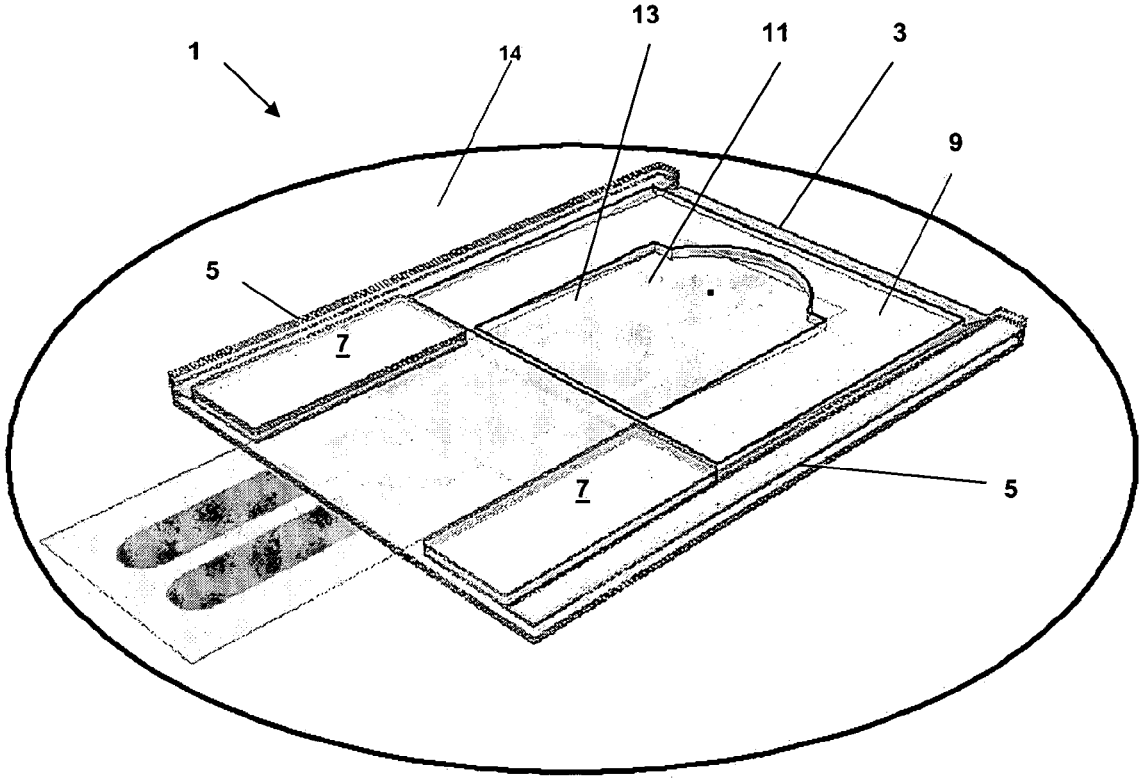
FIG. 2 is a top view of the inflatable lift device positioned above a slip skirt in accordance with the present invention.

With reference to FIG. 2 and with continuing reference to FIG. 1, a slip skirt 14 may also be provided to prevent the sliding or shifting of inflatable lift device 1. Slip skirt 14 is an extra piece of material with a high coefficient of friction that is fastened to the underneath and extends beyond the base of inflatable lift device 1.

Figure 3:
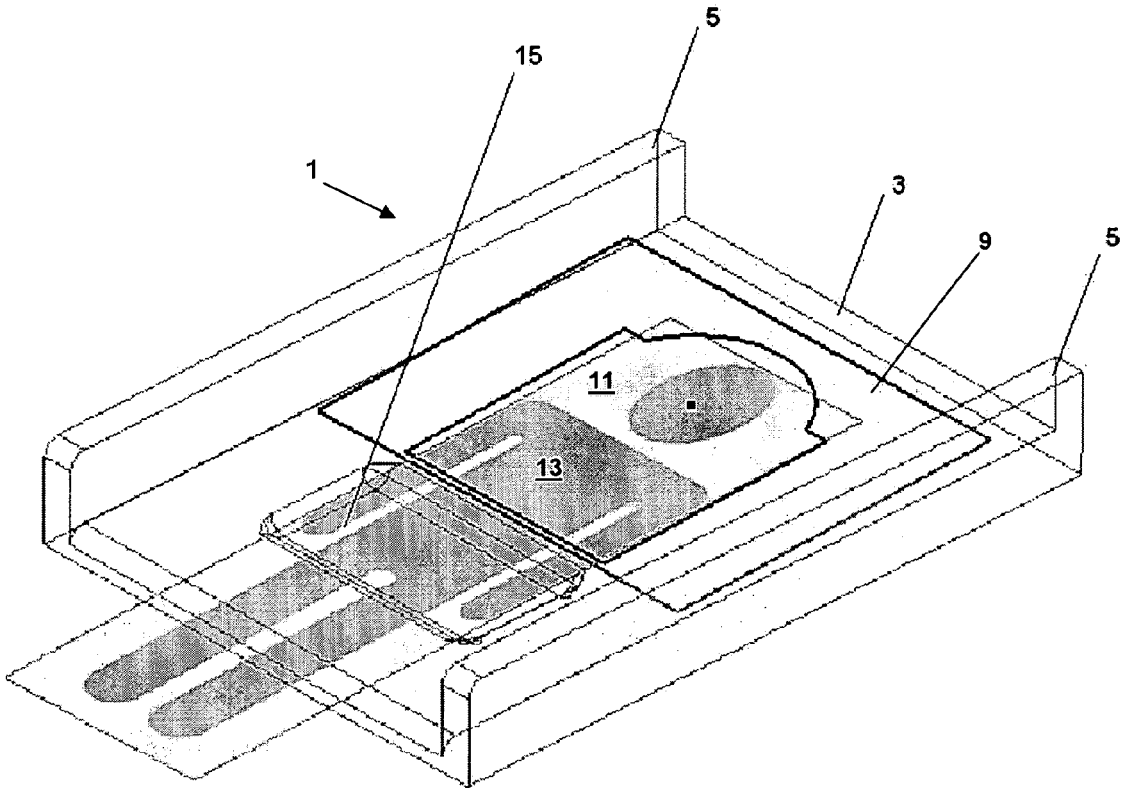
FIG. 3 is a perspective view of the inflatable lift device after a first stage of inflation in accordance with the present invention.

With reference to FIG. 3 and with continuing reference to FIG. 1, the next step in lifting the patient using inflatable lift device 1 is to inflate side rails 5. This provides the patient with a secure area in which to lie and also keeps the patient within the bounds of inflatable lift device 1. During this step, the patient may also be readjusted so as to achieve a perfect fit. The readjusting may be necessary to accommodate the different body types of different people. The three basic body types are ectomorph (i.e., thin physique), endomorph (i.e., rounded physique), and mesomorph (i.e., athletic physique). The readjustment allows people with different body types to be positioned comfortably on inflatable lift device 1.

Inflatable lift device 1 further includes a cavity 15 in which the patient's buttocks may rest. Cavity 15 provides a center of gravity fit, a comfortable position, and an increase in surface area contact between the patient and inflatable lift device 1. An additional inflatable bladder (not shown) may also be positioned within cavity 15. When inflated, this bladder will permit an easier extraction of the patient from inflatable lift device 1.

Figure 4A:
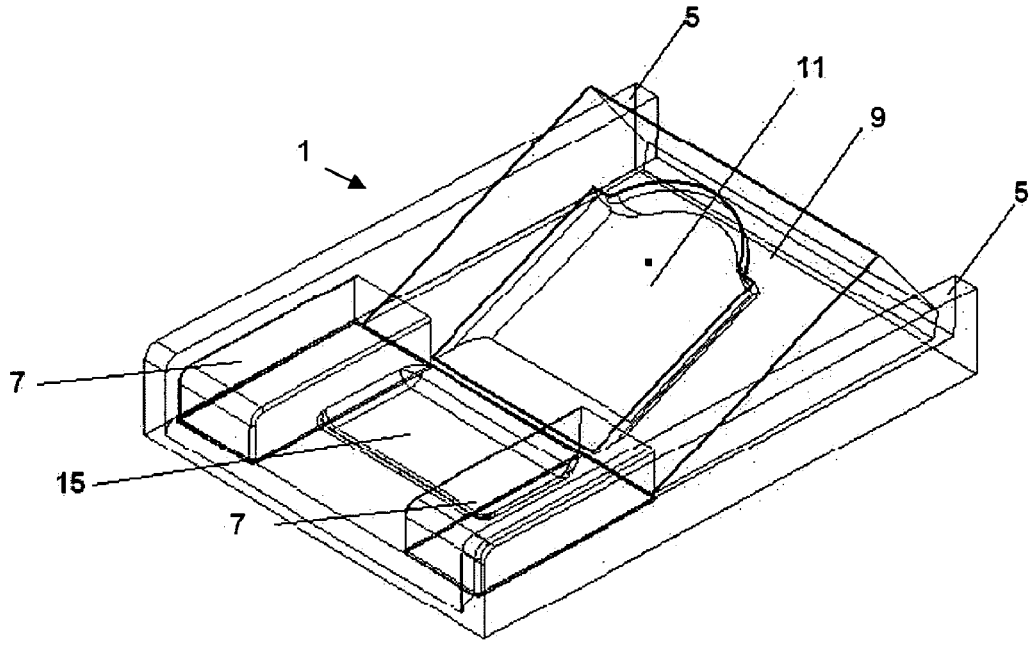
FIGS. 4*a* and 4*b* are perspective views of the inflatable lift device after a second stage of inflation in accordance with the present invention.
Figure 4B:
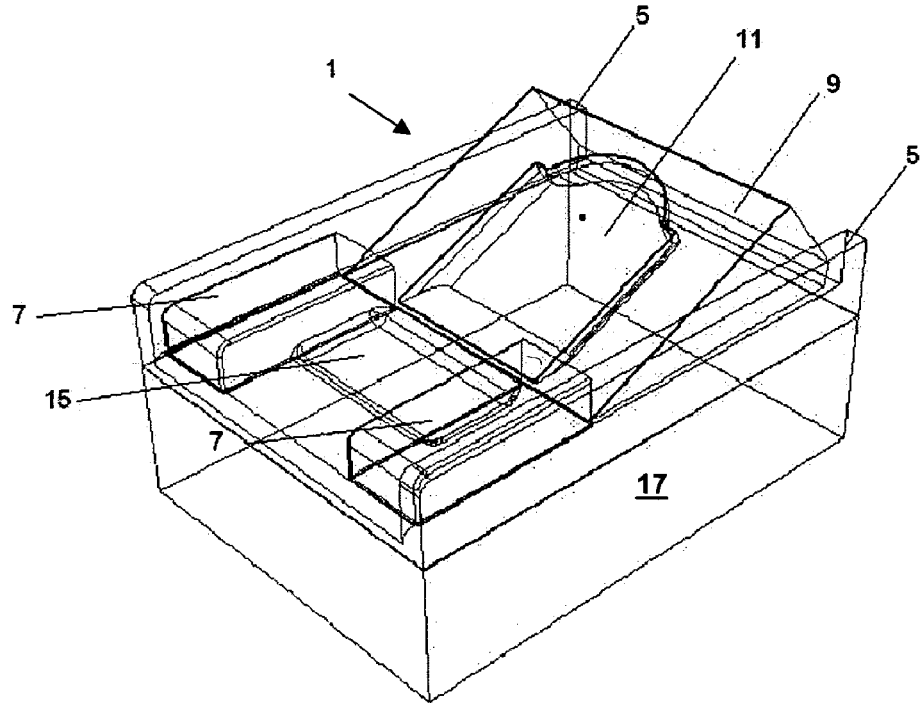

With reference to FIGS. 4*a* and 4*b* and with continuing reference to FIGS. 1 and 3, once side rails 5 are fully inflated, armrests 7 inflate and backrest 9 inflates to a first inflation point. Once armrests 7 are fully inflated and backrest 9 reaches the first inflation point, the patient is completely secured. Armrests 7 secure the patient's waist and thighs while backrest 9 puts a positive pressure on the patient's back. Molded cavity 11 in backrest 9 provides the patient with a comfortable position and an increase in surface area contact between the patient's torso and inflatable lift device 1. Molded cavity 11 also keeps the patient stable by decreasing the ability to roll from side to side.

Next, an inflatable lift bladder 17, of a generally rectangular shape, slowly lifts the secured patient from the ground as shown in FIG. 4*b*. A benefit of slowly lifting a patient from a supine or prone position is that it allows the patient to adjust to the blood pressure shift. When an individual moves from a prone or supine position to an upright position, there is a blood pressure change that may cause light-headedness and fainting symptoms. This is referred to as syncope or Orthostatic Hypotension. The susceptibility to syncope is greater in patients with low blood pressure, diabetes and other conditions. Also, elderly patients are more susceptible to a blood pressure shift.

Figure 5:
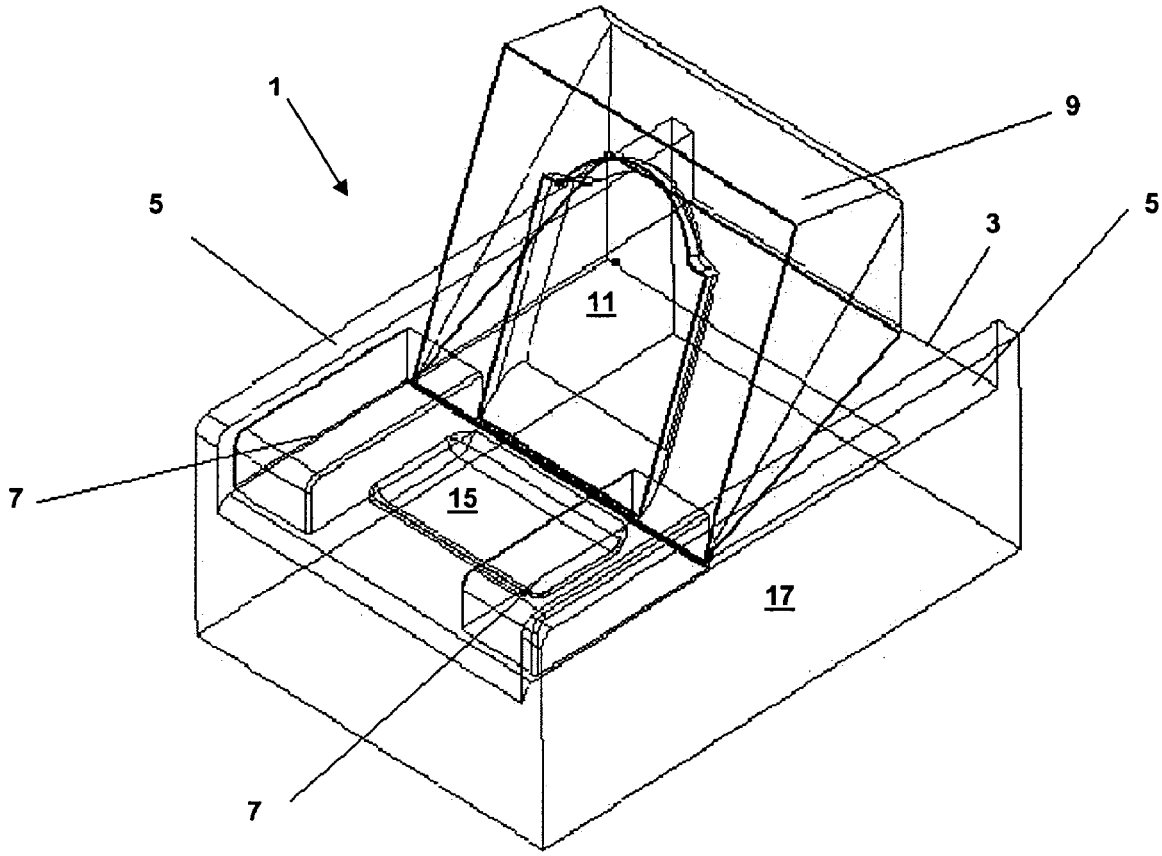
FIG. 5 is a perspective view of the inflatable lift device after a third stage of inflation in accordance with the present invention.
Figure 6:
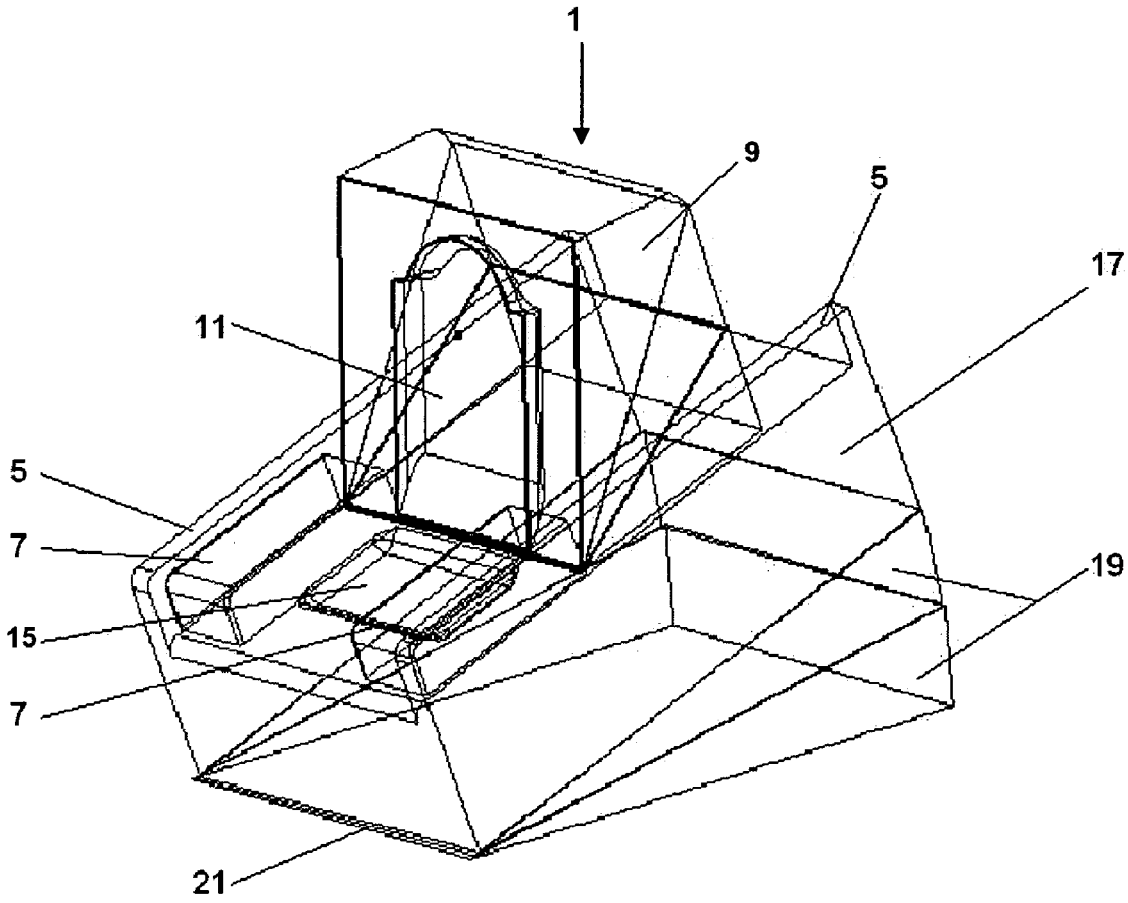
FIG. 6 is a perspective view of the inflatable lift device after an optional fourth stage of inflation in accordance with the present invention.

With reference to FIGS. 5 and 6 and with continuing reference to FIGS. 1, 3, 4*a* and 4*b*, once inflatable lift bladder 17 is fully inflated, backrest 9 continues its slow progression to a near upright position and then to a full upright stage. At this point the patient is in the full sitting position. Inflatable lift device 1 may also include a plurality of inflatable tilt bladders 19 to raise the patient to a standing position. Inflatable tilt bladders 19 have a generally triangular shape and are positioned below inflatable lift bladder 17. Tilt bladders 19 rotate inflatable lift device 1 at the momentum point along the front bottom edge 21 of the device thereby raising a patient from a seated position to a near standing position.

Figure 7:
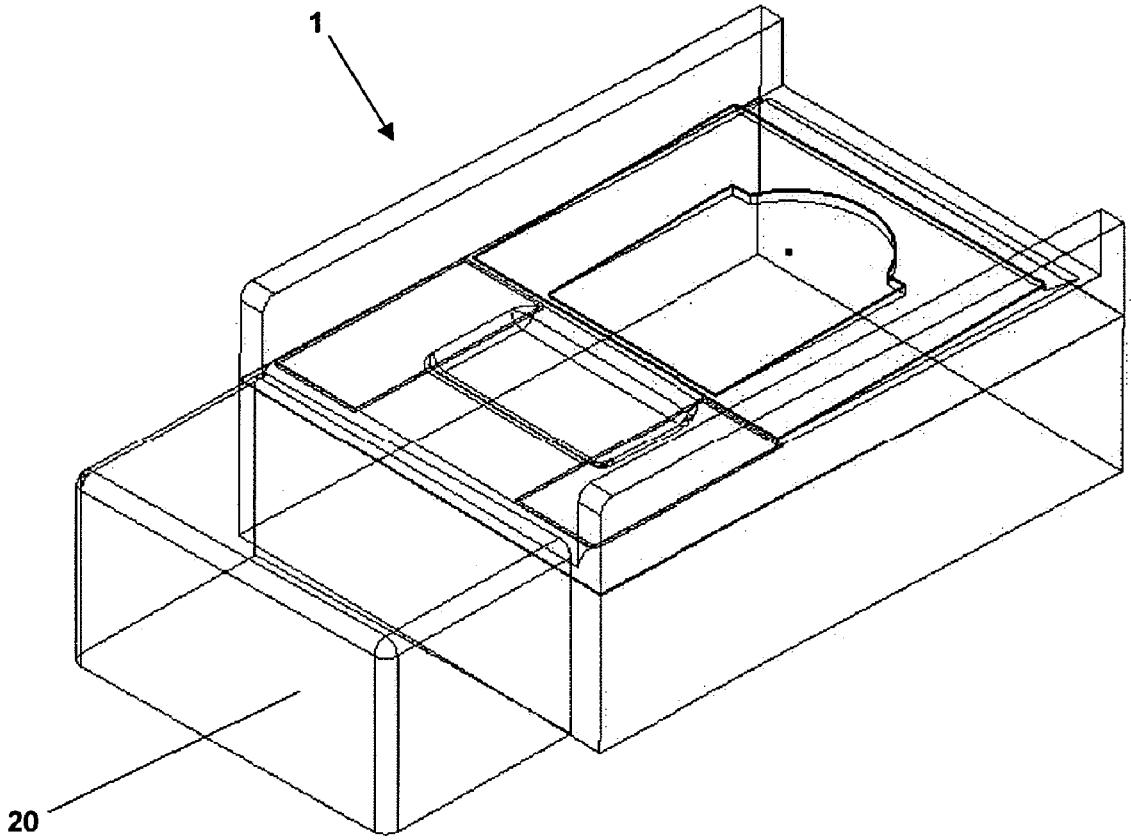
FIG. 7 is a perspective view of the inflatable lift device illustrating an optional inflatable footrest in accordance with the present invention.

With reference to FIG. 7 and with continuing reference to FIGS. 1, 3, 4*a*, 4*b*, 5 and 6, while the types of inflatable bladders used in inflatable lift device 1 were described above as including inflatable side rails 5, inflatable armrests 7, inflatable backrest 9, inflatable lift bladder 17 and optional inflatable tilt bladders 19, this is not to be construed as limiting the present invention to this particular configuration as other configurations have been envisioned. For instance, it is envisioned that an inflatable lift device may include additional bladders that when inflated allow the device to function as a bed for the patient. Bladders may also be included to provide a footrest 20 for the patient.

Figure 8:
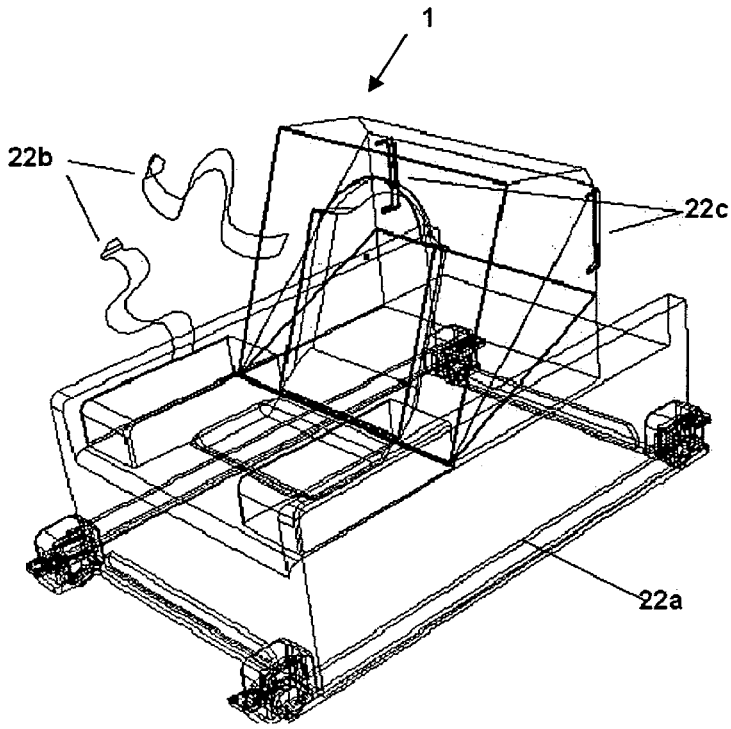
FIG. 8 is a perspective view of the inflatable lift device with wheels, a securing harness and handles attached thereto.
Figure 9:
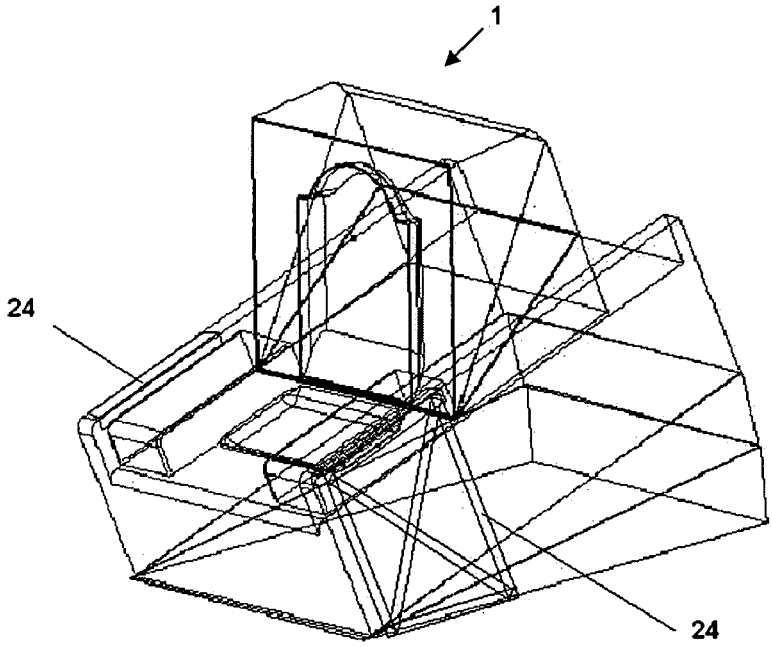
FIG. 9 is a perspective view of the inflatable lift device with a series of prefabricated rods secured thereto.

With reference to FIGS. 8 and 9, additional accessories that aid in patient transportation and comfort may also be added to inflatable lift device 1. Such accessories may include a wheel base 22*a*, a securing harness 22*b*, handles 22*c* and a series of prefabricated rods 24. Wheel base 22*a* may be secured beneath inflatable lift device 1 or it may be retractable within inflatable lift device 1. Wheel base 22*a* permits movement of the patient while the patient is secured within inflatable lift device 1. The securing harness 22*b* includes a series of straps strategically placed on inflatable lift device 1 that secures a patient's torso to the device. Handles 22*c* include a series of handles secured to the device that allow an attendant to safely move the device. The series of prefabricated rods 24 are inserted by an attendant and provide assistance to a patient to get into an upright position.

Figure 10:
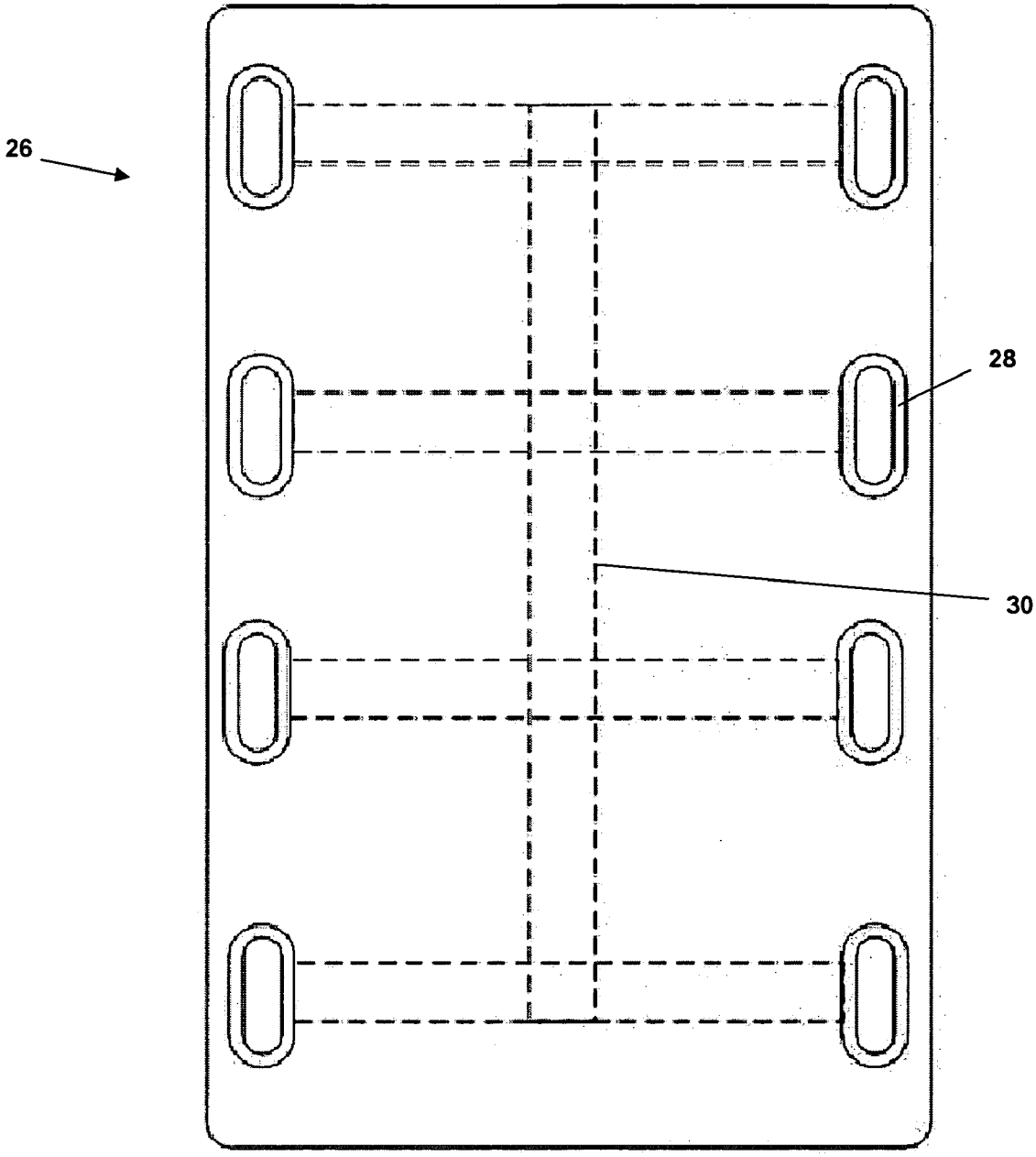
FIG. 10 is a top plan view of a transfer sheet for use with the inflatable lift device in accordance with the present invention.

With reference to FIG. 10, inflatable lift device 1 may be further equipped with a transfer sheet 26. Transfer sheet 26 is approximately the size of flat blanket 3 and provides a barrier between the patient and inflatable lift device 1. Transfer sheet 26 allows an attendant to easily and safely move a patient or subject from inflatable lift device 1 to a bed, chair or the like. Transfer sheet 26 may be secured to the surface of flat blanket 3 or may be free floating for easy removal. Transfer sheet 26 may also include handles 28 and a support grid 30 integrated therein. Transfer sheet 26 may also be constructed from a hypoallergenic material that is latex free such as breathable nylon or a polyester type material.

Figure 11:
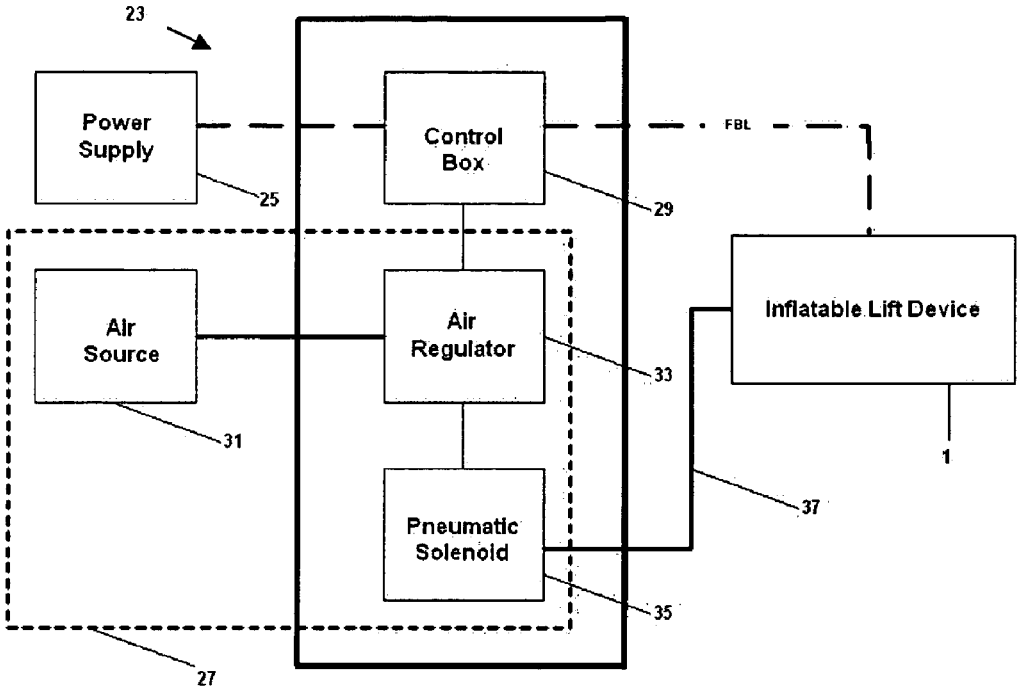
FIG. 11 is a block diagram illustrating the control mechanism of the present invention.

With reference to FIG. 11, inflatable lift device 1 further includes an inflation control device 23 to ensure that all of the inflatable bladders of flat blanket 3 inflate to the proper pressure and in the correct sequence. Inflation control device 23 includes a power supply 25, an air supply 27 and a controller box 29.

Power supply 25 is the source of energy for inflation control device 23. Power supply 25 can be one or a plurality of power sources that may include, but is not limited to, 110 VAC, 220 VAC, batteries, DC voltage and AC/DC voltage. Power supply 25 may also be an Energy Operation Unit (EOU). An EOU is an energy burst type unit, similar to a defibrillator, used to activate control device 23 to operate inflatable lift device 1.

Air supply 27 includes air source 31, air regulator 33 and pneumatic solenoid 35. Air source 31 is driven by power supply 25 and may be a standard off-the-shelf compressor or custom designed compressor driven by AC/DC voltage and/or air. While air source 31 is described as a compressor driven by AC/DC voltage and/or air, this is not to be construed as limiting the invention since it is envisioned that other types of air sources may be used. Air regulator 33 and pneumatic solenoid 35 are controlled by controller box 29 to ensure that the plurality of inflatable bladders are inflated at the proper pressure and in the correct sequence. Air is provided from air supply 27 to the inflatable bladders through tubing 37.

Controller box 29 is a preprogrammed control unit that allows inflatable lift device 1 to inflate through either a preprogrammed automatic mode or manually. In manual mode the operator can inflate and deflate the inflatable lift device as he sees fit. Either a foot pedal or a hand pump may control such manual inflation. The foot pedal allows an operator to control the inflation rate of each of the inflatable bladders of inflatable lift device 1. The hand pump is provided as a means for manual inflation if automatic inflation fails.

Controller box 29 may be further provided with a feedback loop (FBL) to monitor air pressure in each inflatable bladder of inflatable lift device 1. Feedback loop (FBL) also allows controller box 29 to automatically adjust any inflatable bladder that needs extra air pressure or air evacuation. Therefore, a sudden movement by the patient can be safely controlled. Feedback loop (FBL) may be, but is not limited to, an array of pressure sensors (not shown) that monitor and sense the air feeds through tubing 37 that connect to inflatable lift device 1. Inflation control device 23 may further include an assortment of controlled check valves (not shown) that permit the device to deflate or evacuate air as needed. The check valves are capable of unidirectional and bi-directional airflow. Specifically, the check valves allow for air release protection (ARP), a safety mechanism that prevents air from accidentally being released while in use, and automatic air evacuation (AAE), a means of reversing the air flow to optimize the deflation process by sucking the air out of inflatable lift device 1.

Figure 12:
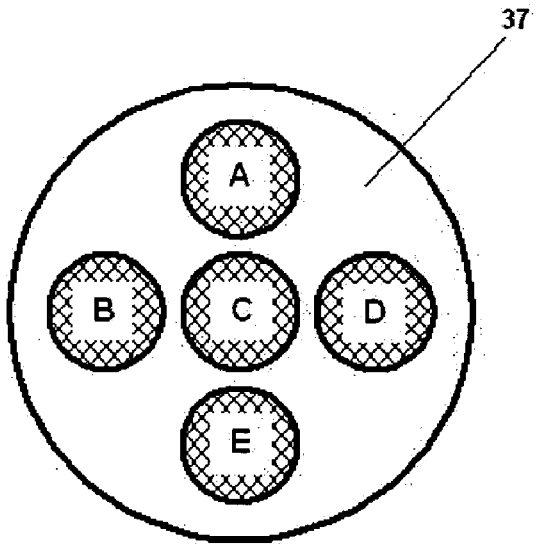
FIG. 12 is a cross-sectional view of the tubing connecting an air supply to the inflatable lift device.

With reference to FIG. 12, and with continuing reference to FIG. 11, air supply 27 is connected to inflatable lift device 1 by means of tubing 37. A cross section of tubing 37 is illustrated in FIG. 12. The core of tubing 37 includes separate air feeds to each of the plurality of inflatable bladders. For instance, air feed A may be connected to inflatable side rails 5, air feed B may be connected to inflatable armrests 7, air feed C may be connected to inflatable backrest 9, air feed D may be connected to inflatable lift bladder 17 and air feed E may be connected to optional tilt bladders 19.

When not in use, inflatable lift device 1 may be stored in a variety of different ways. Since the device is foldable, it may be folded and stored in a backpack style or carryon case style of container for easy transportation. The device may also be packaged in a manner that allows it to be mounted on a wall for easy access during an emergency. A final package style would be to fold the device as small as possible allowing it to be stored in small tight places such as a drawer, under a wheelchair or under a bed.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An inflatable lift device comprising:

a flat blanket having a front, a back, a first side and a second side and including a plurality of inflatable bladders and a seating portion positioned between the first side and the second side of the flat blanket and near the front of the flat blanket, the flat blanket configured to be positioned beneath a patient when the patient is in a supine or prone position on a ground surface;

the plurality of inflatable bladders include:

an inflatable back support positioned between the first side and the second side of the flat blanket and near the back of the flat blanket, the inflatable back support is configured to raise a torso of the patient and support the torso of the patient;

an inflatable lift of a shape that substantially corresponds to a shape of the flat blanket, the inflatable lift configured to lift the patient from the ground surface;

at least one inflatable tilt bladder connected to a bottom portion of the blanket; and an air supply coupled to at least one of the inflatable bladders, wherein the plurality of inflatable bladders are sequentially inflatable with the inflatable back support inflating such that the inflatable back support is inclined relative to the seating portion, which remains substantially parallel to the ground surface thereby raising a patient from the supine or prone position to a seated position, thereafter the inflatable tilt bladder is inflated raising the device and therefore the patient from the seated position to a standing position.

2. The inflatable lift device of claim 1, wherein the plurality of inflatable bladders further includes inflatable side rails, inflatable armrests or any combination thereof.

3. The inflatable lift device of claim 1, further comprising a controller coupled to the air supply for controlling the supply of air to the at least one inflatable bladder.

4. The inflatable lift device of claim 1, wherein the flat blanket includes a non-skid material with a specified coefficient of friction on a bottom portion thereof.

5. The inflatable lift device of claim 1, wherein the air supply includes an air source, an air regulator, a pneumatic solenoid, or any combination thereof.

6. The inflatable lift device of claim 1, further comprising a base with wheels, retractable wheels, or any combination thereof.

7. The inflatable lift device of claim 1, further including a securing harness connected to the blanket and operable to prevent the patient from shifting during inflation.

8. The inflatable lift device of claim 1, wherein handles are secured to the inflatable lift device.

9. The inflatable lift device of claim 1, further comprising a sheet with handles for transferring a patient from the inflatable lift device.

10. The inflatable lift device of claim 1, wherein the flat blanket is foldable for storage when in an uninflated state.

11. An inflatable lift device for lifting a patient from a supine or prone position on a ground surface to a seated position comprising:

a flat blanket including a seating portion, at least an inflatable back support, an inflatable lift and at least one inflatable tilt bladder, the flat blanket configured to be positioned beneath a patient when the patient is in a supine or prone position;

the inflatable back support configured to raise a torso of the patient by inflating in such a manner that the inflatable back support is inclined relative to the seating portion while the seating portion remains substantially parallel to the ground surface; and the inflatable lift having a shape that substantially corresponds to a shape of the flat blanket, the inflatable lift device configured to lift the patient from the ground surface;

the inflatable tilt bladders configured to raise the patient from a seated position to a standing position; and an air supply in fluid communication with at least one of the inflatable back support and inflatable lift, wherein the air supply is operable to sequentially inflate at least one of the inflatable back support and inflatable lift.

12. The inflatable lift device of claim 11, further comprising a controller coupled to the air supply for controlling the supply of air to at least one of the inflatable side rails, inflatable armrests, inflatable backrest and inflatable lift.

13. The inflatable lift device of claim 11, wherein the inflatable backrest includes a molded cavity to stabilize the patient during inflation.

14. The inflatable lift device of claim 11, wherein the flat blanket includes a non-skid material with a high coefficient of friction on the bottom thereof.

15. The inflatable lift device of claim 11, wherein the air supply includes an air source, an air regulator and a pneumatic solenoid.

16. The inflatable lift device of claim 11, further comprising a base with wheels, retractable wheels or any combination thereof.

17. The inflatable lift device of claim 11, further including a securing harness to prevent the patient from shifting during inflation.

* * * * *